US012078164B2

(12) United States Patent
Chandrashekar

(10) Patent No.: US 12,078,164 B2
(45) Date of Patent: Sep. 3, 2024

(54) RECIPROCATING COMPRESSOR WITH A JACKET AROUND THE PISTON ROD

(71) Applicant: NUOVO PIGNONE TECNOLOGIE SRL, Florence (IT)

(72) Inventor: Manjunatha M. Chandrashekar, Bengaluru (IN)

(73) Assignee: Nuovo Pignone Technologie SRL, Florence (IT)

( * ) Notice: Subject to any disclaimer, the term of this patent is extended or adjusted under 35 U.S.C. 154(b) by 16 days.

(21) Appl. No.: 17/997,855

(22) PCT Filed: Apr. 23, 2021

(86) PCT No.: PCT/EP2021/025153

§ 371 (c)(1),
(2) Date: Nov. 3, 2022

(87) PCT Pub. No.: WO2021/223909

PCT Pub. Date: Nov. 11, 2021

(65) Prior Publication Data

US 2023/0151809 A1 May 18, 2023

(30) Foreign Application Priority Data

May 4, 2020 (IT) ..... 102020000009730

(51) Int. Cl.

| | |
|---|---|
| ***F04B 53/00*** | (2006.01) |
| ***F04B 39/00*** | (2006.01) |
| ***F04B 39/12*** | (2006.01) |
| ***F04B 53/14*** | (2006.01) |
| ***F04B 53/16*** | (2006.01) |

(52) U.S. Cl.

CPC ..... *F04B 53/007* (2013.01); *F04B 39/0005* (2013.01); *F04B 39/0022* (2013.01); *F04B 39/122* (2013.01); *F04B 39/126* (2013.01); *F04B 53/143* (2013.01); *F04B 53/164* (2013.01)

(58) Field of Classification Search

CPC .. F04B 39/005; F04B 39/0022; F04B 53/143; F04B 53/164

See application file for complete search history.

(56) References Cited

U.S. PATENT DOCUMENTS 4,424,008 A 1/1984 Braun
4,556,369 A 12/1985 Braun
(Continued)

FOREIGN PATENT DOCUMENTS

DE 3920293 A1 1/1991
DE 102006015327 A1 10/2007
(Continued)

*Primary Examiner* — Thomas E Lazo

(74) *Attorney, Agent, or Firm* — Paul Frank + Collins P.C.

(57) ABSTRACT

The reciprocating compressor has a cylinder with a compression chamber where a piston can slide between a crank-side position and a head-side position; a piston rod is mechanically connected to the piston and during operation of the compressor, slides in a hole of the compression chamber; there is a small gap between the hole and the piston rod; in order to avoid leakage from this gap a jacket is arranged around the piston rod and is sealed on one side to the piston and on the other side to the cylinder at the gap.

20 Claims, 3 Drawing Sheets

(56) References Cited

U.S. PATENT DOCUMENTS

| | | | | | |
|---|---|---|---|---|---|
| 4,975,027 | A * | 12/1990 | Halverson | F04B 37/12 | 417/437 |
| 5,415,531 | A * | 5/1995 | Cavanaugh | F04B 9/133 | 417/403 |
| 5,525,047 | A | 6/1996 | Sternenberg et al. | | |
| 5,655,778 | A * | 8/1997 | Cavanaugh | F16J 3/042 | 277/924 |
| 6,357,755 | B1 * | 3/2002 | Feistel | F16J 15/102 | 277/540 |
| 8,123,500 | B2 * | 2/2012 | Juterbock | F04B 43/0736 | 417/397 |
| 10,697,443 | B2 * | 6/2020 | Preuss | B05B 9/0409 | |
| 2017/0152841 | A1 * | 6/2017 | Preuss | F04B 43/073 | |
| 2019/0345923 | A1 | 11/2019 | Mccoy | | |

FOREIGN PATENT DOCUMENTS

| | | | |
|---|---|---|---|
| DE | 102008058704 | A1 | 6/2009 |
| EP | 0933566 | A1 | 8/1999 |
| FR | 2385427 | A1 | 10/1978 |
| FR | 2695965 | A1 | 3/1994 |
| JP | H08 303890 | A | 11/1996 |
| RU | 2053461 | C1 | 1/1996 |
| RU | 2118766 | C1 | 9/1998 |
| RU | 2154190 | C2 | 8/2000 |

* cited by examiner

RECIPROCATING COMPRESSOR WITH A JACKET AROUND THE PISTON ROD

TECHNICAL FIELD

The subject-matter disclosed herein relates to a reciprocating compressor.

BACKGROUND ART

Conventional reciprocating compressors have a piston housed inside a cylinder and a rod mechanically connected to the piston in order to drive it. The cylinder has an opening wherein the rod can slide in order to allow reciprocating motion of the rod. This opening needs to be sealed around the piston rod in order to reduce gas leakage from the cylinder.

According to known solutions, sealing of the opening of the cylinder around the piston rod is accomplished by a packing arrangement comprising a series of rings made of semi-crystalline thermoplastic, such as polyether ether ketone commonly known as "PEEK", arranged around the piston rod and housed in so-called "cups". The PEEK rings are basically split in design and are embraced by spring elements which compress the split rings circumferentially so that they protrude against the piston rod, positively sealing the clearance between the rings and the piston rod.

Disadvantageously, the PEEK rings pressed against the piston rod do not provide a perfect sealing and, some gas may escape from the cylinder through the cups during the reciprocating motion of the piston rod. Also, the PEEK rings pressed against the piston rod determine friction during the reciprocating motion of the piston which leads to energy consumption and to wear of the piston rod.

SUMMARY

A reciprocating compressors with a cylinder having an improved sealing of the gap around the piston rod would be desirable.

According to a first aspect, the subject-matter disclosed herein relates to a reciprocating compressor; the reciprocating compressor includes a cylinder and a piston sliding inside the compression chamber of the cylinder; a piston rod is mechanically connected to said piston and passes through a hole of the cylinder so that there is an annular gap between the piston rod and the hole; in order to avoid (or at least limit) leakage of gas from the gap, a jacket is arranged around the piston rod; the jacket is attached to the piston on one side and to the cylinder of the other side.

According to a second aspect, the subject-matter disclosed herein relates to a method of avoiding or limiting leakage from a compression chamber of a reciprocating compressor; in particular, leakage occurs through a gap around a rod of a piston of the reciprocating compressor; leakage is avoided (or at least limited) by isolating the piston rod from the gas in the compression chamber; advantageously, isolation is accomplished by arranging a jacket around the piston rod.

BRIEF DESCRIPTION OF THE DRAWINGS

A more complete appreciation of the disclosed embodiments and of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
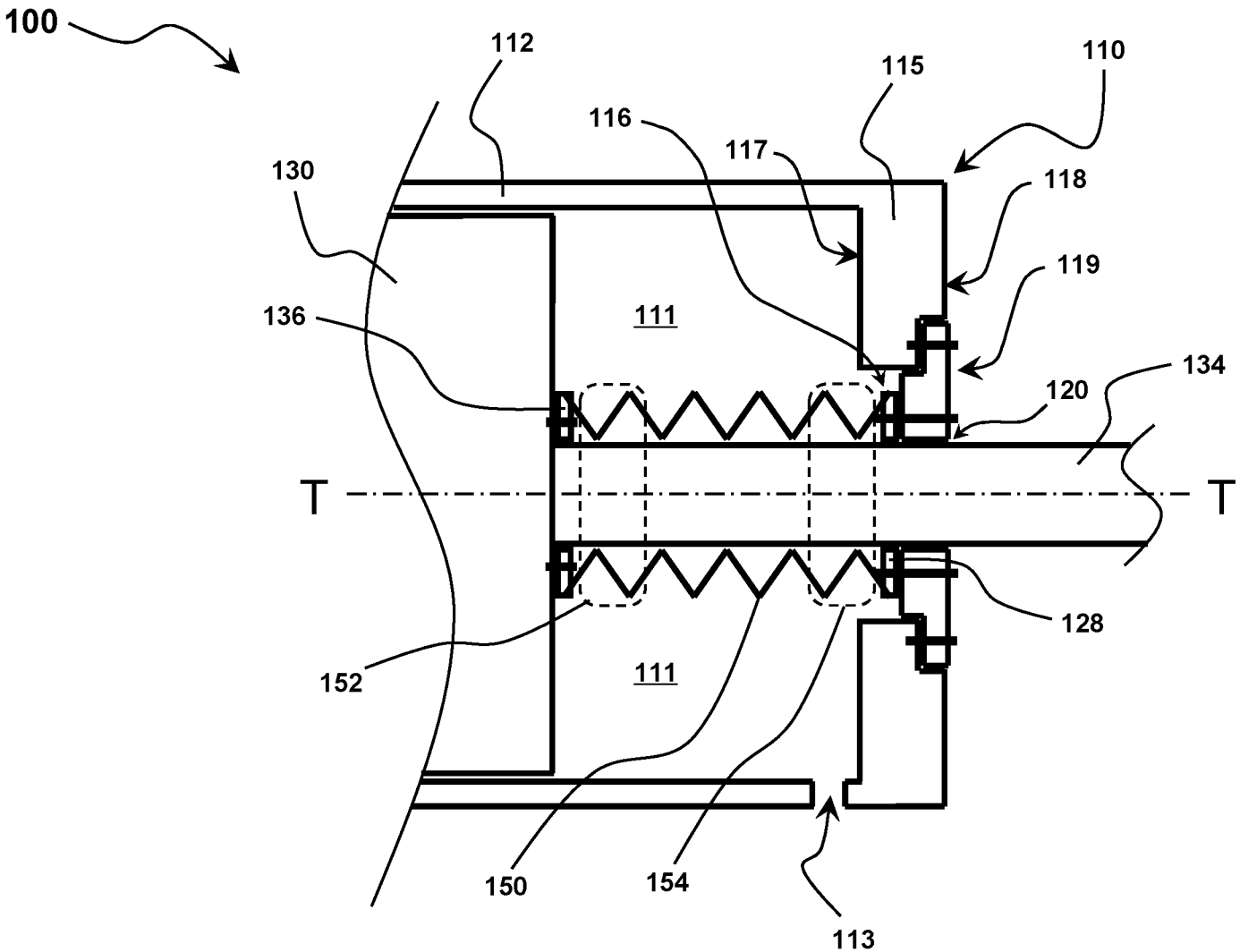
FIG. 1 shows a schematic cross-section of an embodiment of a reciprocating compressor in a first position during operation, namely when the piston is in its head-side position.

In prior-art reciprocating compressor, i.e. compressors in which a piston moves back and forth inside a compression chamber, gas may exit the compression chamber from a gap between a rod of the piston and a hole in a wall of the compression chamber while the piston rod moves back and forth through the hole. In order to avoid the exit of the gas, in the inventive reciprocating compressors, the piston rod has a sealing jacket so that gas surrounding the piston rod cannot get in contact with the piston rod and flow through the gap around the piston rod.

Reference now will be made in detail to embodiments of the disclosure, an example of which is illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure.

Figure 2:
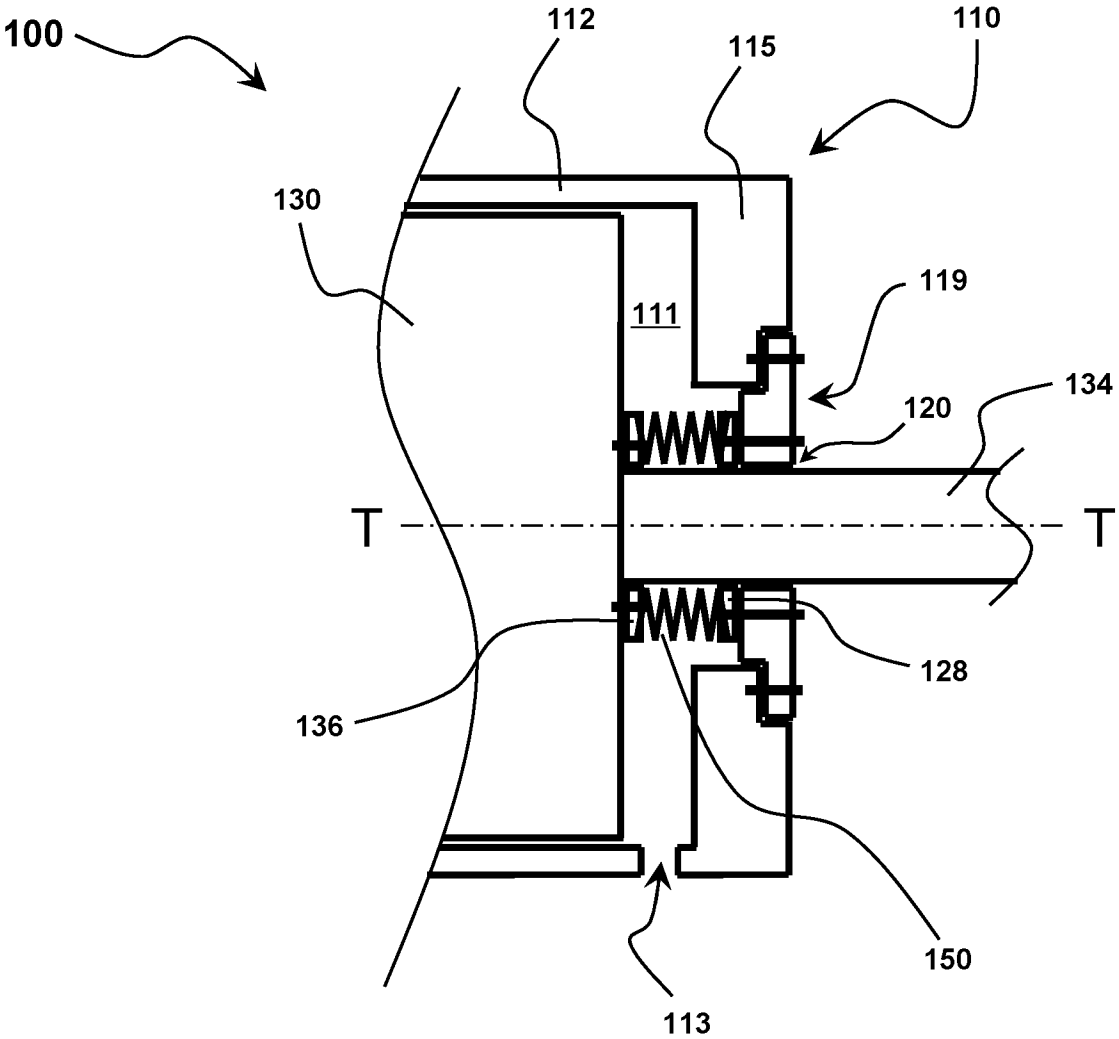
FIG. 2 shows a schematic cross-section of the embodiment of FIG. 1 in a second position during operation, namely when the piston is in its crank-side position.
Figure 3:
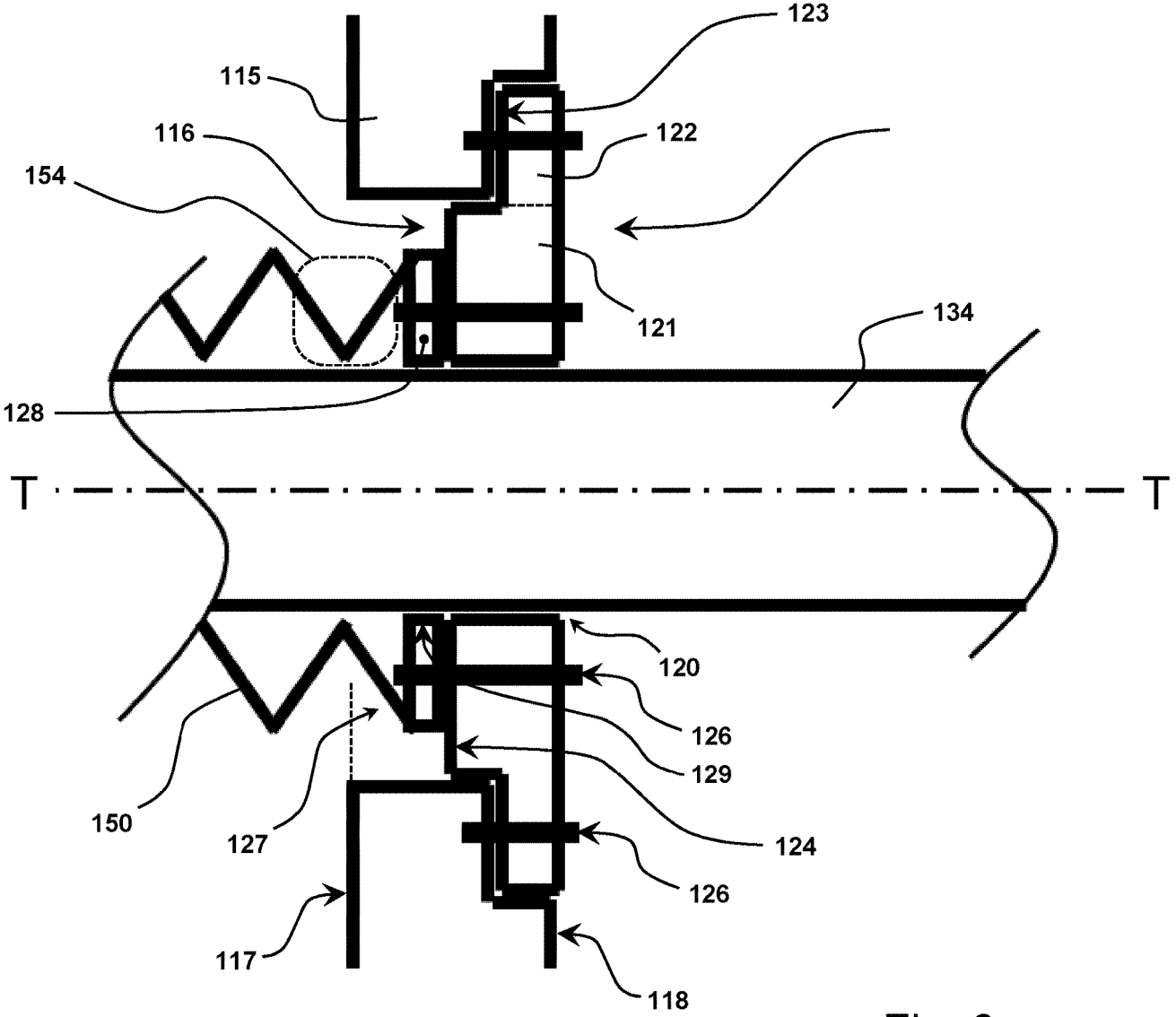
FIG. 3 shows an enlarged view of the cross-section of FIG. 2.

FIGS. 1, 2 and 3 show a reciprocating compressor 100. These figures, in particular FIG. 1 and FIG. 2, show one cylinder 110 and one piston 130 of reciprocating compressor 100. However, alternative reciprocating compressors according to the subject-matter disclosed herein may have any number of cylinders and pistons; in particular, according to some embodiments, one piston may be mechanically connected to two piston rods on opposite sides the piston.

A piston rod 134 is mechanically connected to piston 130 and protrudes from a first side of piston 130. Piston rod 134 may be integral with piston 130 or rigidly connected to it.

Cylinder 110 has a compression chamber 111; in FIG. 1, reference number 111 is placed both above and below piston rod 134 to make it clear that the compression chamber surrounds laterally the piston rod and may be cylinder-shaped. Alternative reciprocating compressors according to the subject-matter disclosed herein may have another compression chamber on the opposite side of the piston which side is not shown in FIG. 1.

Piston 130 is slidably arranged in compression chamber 111 in order to be movable in a reciprocating translational motion along an axis of translation "T" to compress the gas inside compression chamber 111; piston rod 134 has a corresponding reciprocating translational motion. In particular, piston 130 is movable between a head-side position, corresponding to the position of the piston in FIG. 1, and a crank-side position, corresponding to the position of the piston in FIG. 2; in the head-side position a big portion of piston rod 134 is located inside compression chamber 111 while in the crank-side position a small portion of piston rod 134 is located inside compression chamber 111.

According to the embodiment of the figures, cylinder 110 comprises a lateral wall 112, a crank-side wall 115 and a head-side wall, not shown in the annexed figures; the lateral wall may be cylindrical; the crank-side wall and head-side wall may be circular. Lateral cylindrical wall 112 has one or more flow passages 113 fluidly coupled to valves (not shown in the annexed figures) which control the inlet gas flow and outlet gas flow to and from compression chamber 111. The head-side wall and the crank-side wall are arranged perpendicularly to the axis of translation "T". Crank side wall 115 has an opening 116 for piston rod 134, in particular located at the axis of translation "T", an internal surface 117 facing compression chamber 111 and an external surface 118 opposite to internal surface 117. Piston rod 134 is arranged to pass through opening 116.

According to alternative embodiments, both the crank-side wall and the head-side wall may have an opening, in particular both located around the axis of translation "T", for two piston rods; in this case, the reciprocating compressor has two compression chambers.

According to the embodiment of the figures, a so-called "packing body" 119 is sealingly connected to crank-side wall 115 at opening 116. Packing body 119 has a hole 120 for piston rod 134, preferably located along the axis of translation "T". Piston rod 134 is slidably inserted through hole 120, and has a head-side end mechanically connected to piston 130 and is located inside compression chamber 111 at any operating time of the alternating compressor, and a crank-side end mechanically connected to a crank mechanism (not shown in the annexed figures) and is located outside of compression chamber 111 at any operating time of the alternating compressor. The crank mechanism is arranged to drive piston 130 in its reciprocating motion. Packing body 119 may be arranged to provide a degree of sealing to hole 120 when piston rod 134 moves inside it with reciprocating motion.

Advantageously, packing body 119 is or includes a flanged bushing 121 defining hole 120 and having a flange 122 arranged to be fastened to crank-side wall 115, as it is shown in FIG. 3.

In particular, flange 122 of bushing 121 has an annular surface 123 arranged to be pressed against crank-side wall 115. Preferably, a sealing element is interposed between annular surface 123 of the packing body 119 and crank-side wall 115. Tie rods 126 may be used to press packing body 119 against crank-side wall 115 in order to sealingly couple them. In the configuration shown in the figures (see in particular FIG. 3), packing body 119 may be installed on and removed from crank-side wall 115 from the outside of compression chamber 111.

Bushing 121 is completely inserted into opening 116 when packing body 119 is mounted to crank-side wall 115; alternatively, the bushing is inserted only partially into the opening. Advantageously, bushing 121 has another annular surface 124 arranged to face compression chamber 111 when packing body 119 is mounted to crank-side wall 115, that may be used for attaching a jacket of the piston rod that will be described in the following; in particular, the radial position of annular surface 124 is inner with respect to the radial position of annular surface 123.

Advantageously, cylinder 110, in particular crank-side wall 115. has a recess 127 for housing at least partially a jacket that will be described in the following. In the embodiment of the figures (see in particular FIG. 3), recess 127 is part of opening 116 and partially defined by annular surface 124 of the packing body 119 internal surface 117 of the crank-side wall 115 (see dashed line in FIG. 3).

Reciprocating compressor 100 further includes a jacket 150 arranged around piston rod 134, and located inside compression chamber 111, in order to seal compression chamber 111 with respect to hole 120. Jacket 150 extends from a piston-side end 152 to a cylinder-side end 154. Thanks to the sealing effect provided by the jacket, the packing body may be designed so to provide no sealing or only limited sealing to the hole where the piston is inserted.

The piston-side end 152 of the jacket 150 is sealingly attached to piston 130, in particular to a piston flange 136 fixed to piston 130 in order to sealingly couple piston-side end 152 to piston 130. Preferably, jacket 150 and the piston flange 136 are bounded through pressing process and/or by using a bonding agent. Advantageously, piston flange 136 is arranged around piston rod 134 and has an inner e.g. cylindrical surface 137 which faces piston rod 134 and match with the shape of an outer surface e.g. cylindrical of piston rod 134.

Cylinder-side end 154 of jacket 150 is sealingly attached to cylinder 110, in particular to the packing body 119 that is fixed to crank-side wall 115 of cylinder 110. Advantageously, cylinder 110 comprises a cylinder flange 128 fastened to inner annular surface 124 of packing body 119, in order to sealingly connect cylinder-side end 154 of jacket 150 to packing body 119. Preferably, jacket 150 and cylinder flange 128 are bounded through pressing process and/or by using a bonding agent. Advantageously, cylinder flange 128 is arranged around piston rod 134 and has an inner e.g. cylindrical surface 129 which faces piston rod 134 and match with the shape of an outer surface e.g. cylindrical of piston rod 134.

Jacket 150 is arranged to adapt to different positions of piston 130 between the head-side position (see FIG. 1) and the crank-side position (see FIG. 2). In particular, jacket 150 is extendable along the axis of translation "T"; in the head-side position of piston 130 corresponding to the maximum distance of piston 130 from packing body 119, jacket 150 is in its extended configuration or maximum extension; in the crank-side position of piston 130 corresponding to the minimum distance of piston 130 from packing body 119, jacket 150 is in its retracted configuration or minimum extension. It is to be noted that, according to the embodiment of the figures, jacket 150 is always partially housed in recess 127; however, in the retracted configuration a bigger part of the jacket is housed in the recess up to the whole jacket.

FIG. 2 differs from FIG. 1 in that piston 130 is closer to crank-side wall 115 of cylinder 110 and packing body 119; consequently, piston flange 136 is closer to cylinder flange 128; jacket 150 is retracted; the volume of compression chamber 111 is smaller.

Preferably, jacket 150 is made of a gas-poof, flexible and durable material such as a synthetic rubber material or a flexible composite material.

According to the embodiment of the figures, jacket 150 is bellow-shaped and foldable in order to adapt to the different positions of piston 130 between the head-side position and the crank-side position. Advantageously, jacket 150 may be not only bellow-shaped but also elastically extendable.

According to other embodiments not illustrated in the annexed figures, the piston may have a recess located around the piston rod in order to house at least partially the jacket especially when the jacket is in its retracted configuration and the piston is in its crank-side position.

According to still other embodiments not illustrated in the annexed figures, both the cylinder and the piston may have recesses in order to house at least partially the jacket especially when the jacket is in its retracted configuration and the piston is in its crank-side position.

According to another aspect, the subject matter described herein related to a method of avoiding (or at least limiting) leakage from a compression chamber of a reciprocating compressor through a gap around a rod of a piston sliding inside a cylinder of the reciprocating compressor. The method is implemented for example by the embodiment of reciprocating compressor described above and shown in the annexed figures; the following description of the method will make reference to this embodiment without any limiting intention.

The method comprises a step of sealingly isolating the piston rod from the gas in the compression chamber. For example, according to the above mentioned embodiment, piston rod 134 is isolated from the gas in the compression chamber 111 at any operating time of the alternating compressor.

Advantageously, for example in the embodiment of the annexed figures, the step of isolating comprises arranging a jacket, labeled 150 in the annexed figures, around the piston rod, labeled 134 in the annexed figures.

In order to achieve sealing, a piston-side end 152 of the jacket 150 may be sealingly attached to the piston 130 and/or cylinder-side end 152 of the jacket 150 may be sealingly attached to the cylinder 110, in particular to a so-called "packing body" 119 of the cylinder as previously described.

The invention claimed is:

1. A reciprocating compressor, comprising:

a piston;

a piston rod mechanically connected to the piston;

a cylinder comprising a compression chamber slidingly housing the piston, the cylinder comprising an opening through which the piston rod is arranged to slide along an axis of translation between a head-side position and a crank-side position; and a jacket arranged around the piston rod, the jacket comprising a piston-side end sealingly attached to the piston and a cylinder-side end sealingly attached to the cylinder to seal the compression chamber, wherein the cylinder has a wall that comprises an annular recess located around the hole to house part of the jacket when the piston is in the head-side position.

2. The reciprocating compressor of claim 1, wherein the jacket is arranged to adapt to different positions of the piston between the crank-side position and the head-side position.

3. The reciprocating compressor of claim 1, wherein the jacket is elastically extendable along the axis of translation of the piston to adapt to different positions of the piston.

4. The reciprocating compressor of claim 1, wherein the jacket is bellow-shaped.

5. The reciprocating compressor of claim 1, wherein the annular recess houses part of the jacket when the piston is in the crank-side position.

6. The reciprocating compressor of claim 1, further comprising:

a packing body sealingly mounted to the cylinder in the opening.

7. The reciprocating compressor of claim 1, wherein the jacket comprises a synthetic rubber material.

8. The reciprocating compressor of claim 1, wherein the jacket is foldable to adapt to different positions of the piston.

9. The reciprocating compressor of claim 1, further comprising:

a packing body disposed in the opening of the cylinder, wherein the packing body is annular and defines a hole to receive the piston rod.

10. The reciprocating compressor of claim 1, further comprising:

a packing body disposed in the opening of the cylinder, and wherein the cylinder-side end of the jacket is sealingly attached to the packing body.

11. The reciprocating compressor of claim 1, wherein the jacket comprises a synthetic flexible composite material.

12. A reciprocating compressor, comprising:

a piston;

a piston rod mechanically connected to the piston, a piston flange fixed to the piston;

a cylinder comprising a compression chamber slidingly housing the piston, the cylinder comprising an opening through which the rod is arranged to slide along an axis of translation; and a jacket arranged around the piston rod, the jacket comprising a piston-side end sealingly attached to the piston and a cylinder-side end sealingly attached to the cylinder in order to seal the compression chamber, wherein the piston-side end of the jacket is sealingly directly attached to the piston flange.

13. The reciprocating compressor of claim 12, further comprising:

a packing body sealingly mounted to the cylinder in the opening.

14. The reciprocating compressor of claim 12, further comprising:

a packing body sealingly mounted to the cylinder in the opening, the packing body comprising a peripheral annular surface and an inner annular surface, wherein the cylinder flange is fixed to the inner annular surface.

15. A reciprocating compressor, comprising:

a piston;

a piston rod mechanically connected to the piston, a cylinder comprising a compression chamber slidingly housing the piston, the cylinder comprising an opening through which the piston rod is arranged to slide along an axis of translation, the cylinder further comprising a cylinder flange;

a jacket arranged around the piston rod, the jacket comprising a piston-side end sealingly attached to the piston and a cylinder-side end sealingly directly attached to the cylinder flange.

16. The reciprocating compressor of claim 15, further comprising:

a packing body sealingly mounted to the cylinder in the opening, the packing body comprising a peripheral annular surface and an inner annular surface, wherein the cylinder flange is fixed to the inner annular surface.

17. The reciprocating compressor of claim 15, further comprising:

a packing body sealingly mounted to the cylinder in the opening.

18. The reciprocating compressor of claim 15, wherein the jacket comprises a synthetic flexible composite material.

19. The reciprocating compressor of claim 15, wherein the jacket is bellow-shaped.

20. The reciprocating compressor of claim 15, wherein the jacket is elastically extendable along the axis of translation of the piston to adapt to different positions of the piston.

* * * * *